US008138926B2

(12) United States Patent
Bomba et al.

(10) Patent No.: US 8,138,926 B2
(45) Date of Patent: Mar. 20, 2012

(54) METHODS AND APPARATUS FOR MONITORING AND GUIDING HUMAN SUBJECTS INTERACTING WITH OBJECTS

(75) Inventors: Frank Bomba, Boston, MA (US); Beth Logan, Cambridge, MA (US); Jean-Manuel Van Thong, Arlington, MA (US)

(73) Assignee: Intel-GE Care Innovations LLC, Roseville, CA (US)

( * ) Notice: Subject to any disclaimer, the term of this patent is extended or adjusted under 35 U.S.C. 154(b) by 266 days.

(21) Appl. No.: 12/215,816

(22) Filed: Jun. 30, 2008

(65) Prior Publication Data

US 2009/0322533 A1 Dec. 31, 2009

(51) Int. Cl.
*G08B 23/00* (2006.01)

(52) U.S. Cl. ..... 340/573.1; 600/301

(58) Field of Classification Search ..... 340/573.1; 600/301; 701/36
See application file for complete search history.

(56) References Cited

U.S. PATENT DOCUMENTS

2005/0133543 A1* 6/2005 Clifford et al. ..... 222/420
2007/0135691 A1* 6/2007 Zingelewicz et al. ..... 600/301
2007/0239331 A1* 10/2007 Kaplan ..... 701/36

OTHER PUBLICATIONS

Lester, Jonathan et al., "Are You With Me?"—Using Accelerometers to Determine if Two Devices are Carried by the Same Person, Dated Jan. 2008, pp. 1-18.
Mayrhofer, Rene et al., "Shake Well Before Use: Authentication Based on Accelerometer Data" LNCS 4480, Dated 2007, pp. 144-161.
Holmquist, Lars Erik et al., "Smart-Its Friends: A Technique for Users to Easily Establish Connections between Smart Artefacts" Ubicomp 2001, LNCS 2201, Dated 2001, pp. 116-122.
"Nokia enables Bluetooth NFC pairing", Dated Apr. 15, 2008, http://news.cnet.com/8301-17938_105-9919123-1.html.
"Trashcam: An Embedded Device for Home Activity Monitoring," U.S. Appl. No. 11/961,509, filed Dec. 20, 2007.
"Method and Apparatus to Detect Ambulation", U.S. Appl. No. 11/963,278, filed Dec. 21, 2007.

* cited by examiner

*Primary Examiner* — Shirley Lu
(74) *Attorney, Agent, or Firm* — Pillsbury Winthrop Shaw Pittman LLP

(57) ABSTRACT

Motion detecting devices may be used to help monitor and guide human subjects interacting with objects. An activity monitoring station may receive an interaction schedule for a human subject. The schedule may list objects with which the human subject is scheduled to interact. The station may receive motion data from a motion detecting device worn by the subject and a device situated on or in an object. The station may generate a motion alignment score, based on the motion data, and may determine that the subject has interacted with the object, based on the alignment score. The station may also automatically determine whether the interaction is an approved interaction or a disapproved interaction, based on the schedule. The station may automatically cause an approval or disapproval signal to be generated for the human subject. Interaction reports may be generated and transmitted to caregivers. Other embodiments are described and claimed.

6 Claims, 3 Drawing Sheets

METHODS AND APPARATUS FOR MONITORING AND GUIDING HUMAN SUBJECTS INTERACTING WITH OBJECTS

FIELD OF THE INVENTION

The present disclosure relates generally to the field of data processing, and more particularly to methods and related apparatus for monitoring and guiding human subjects interacting with objects.

BACKGROUND

Many people rely on medicine to help cope with ailments. For optimum efficacy, medications may need to be taken according to a specific schedule. For people who regularly take multiple different medications, it can be difficult to consistently follow the directions for all of the different medications. For instance, when a person or "subject" is supposed to take a variety of different pills at different times during the day, it may be difficult for that person to keep track of which pills need to be taken at a given time, which pills have already been taken, etc. Moreover, problems with perception (e.g., due to poor eyesight) or cognition (e.g., due to Alzheimer's disease) can substantially increase the likelihood that the subject will not properly follow the medication regimen.

In addition to tracking medication usage, it could also be useful to track many other types of activities or interaction, to provide more effective assisted living. For instance, it might be useful to track eating practices, movements within the house, etc. It could also be helpful to be able to track and distinguish activities and interactions of two or more people within the same household or living environment.

Radio frequency identification (RFID) tags and readers may be used to monitor interaction between a person and an object. For instance, an RFID reader may be used to control a door lock, and a person can swipe a badge with an RFID tag near the RFID reader to unlock the door. However, since RFID readers detect proximity, they may be difficult to adapt for use in tracking medication usage. For instance, if a person were to select a pill bottle from a shelf with many other pill bottles, an RFID reader might have difficulty determining which particular pill bottle was chosen.

BRIEF DESCRIPTION OF THE DRAWINGS

Features and advantages of the present invention will become apparent from the appended claims, the following detailed description of one or more example embodiments, and the corresponding figures, in which:

DETAILED DESCRIPTION

Figure 1:
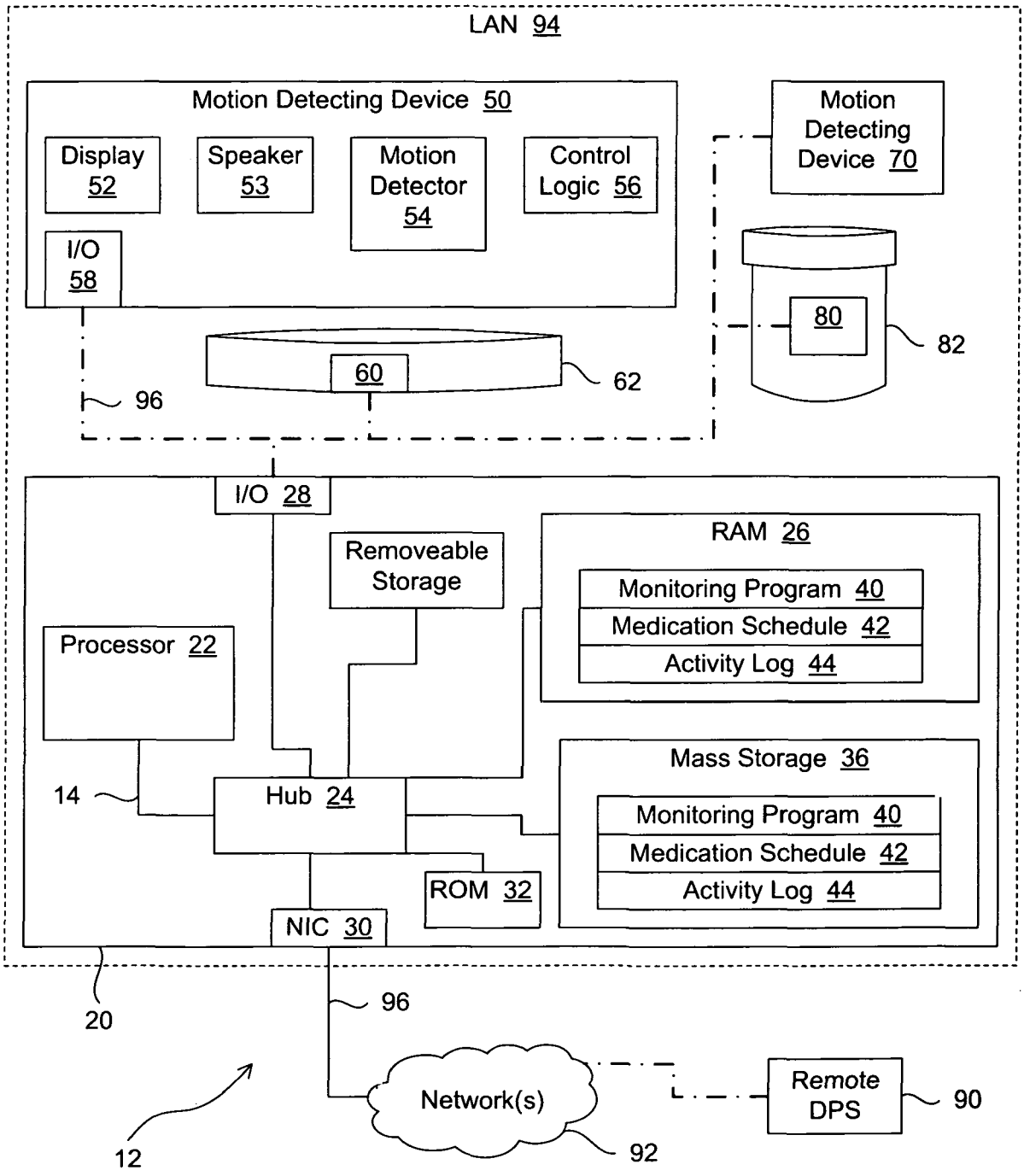
FIG. 1 is a block diagram depicting a suitable data processing environment in which certain aspects of an example embodiment of the present invention may be implemented.

FIG. 1 is a block diagram depicting a suitable data processing environment 12 in which certain aspects of an example embodiment of the present invention may be implemented. Data processing environment 12 includes a processing system 20 that has various hardware and software components. The hardware components include a processor 22, random access memory (RAM) 26, and read-only memory (ROM) 32. Alternatively, a data processing system may include multiple processors. Processor 22 may include one or more processing units or cores. Such processing units may be implemented as Hyper-Threading (HT) technology, or as any other suitable technology for executing multiple threads or instructions simultaneously or substantially simultaneously.

Processing system 20 may also include other hardware components, and the hardware components may be communicatively coupled via one or more system buses 14 or other communication pathways or mediums. This disclosure uses the term "bus" to refer to shared (e.g., multi-drop) communication pathways, as well as point-to-point pathways, interconnect rings, etc. In the embodiment of FIG. 1, processing system 20 includes one or more volatile and/or non-volatile data storage devices, such as RAM 26, ROM 32, mass storage devices 36 such as hard drives, and/or other devices or media. For example, processing system 20 may include one or more removable storage devices, such as drives for digital versatile disks (DVDs) or other kinds of optical disks, floppy disk drives, tapes, flash memory, memory sticks, etc. For purposes of this disclosure, the terms "read-only memory" and "ROM" may be used in general to refer to non-volatile memory devices such as erasable programmable ROM (EPROM), electrically erasable programmable ROM (EEPROM), flash ROM, flash memory, etc. Processing system 20 may also have a chipset, a bridge, a hub 24, and/or other modules which serve to interconnect various hardware components.

Processing system 20 may be controlled, at least in part, by input from input devices such as a keyboard, a mouse, a remote control, etc., and/or by directives received from another machine, biometric feedback, or other input sources or signals. Processing system 20 may utilize one or more communication ports and one or more wired or wireless connections to communicate with one or more other data processing systems. Communication ports may also be referred to as input/output (I/O) ports, and they may be implemented as parallel ports, serial ports, universal serial bus (USB) controllers, high-definition multimedia interface (HDMI) ports, network interface controllers (NICs), modems, etc.

In various embodiments, processing systems may be interconnected by way of a physical and/or logical network, such as a local area network (LAN), a wide area network (WAN), an intranet, the Internet, etc. Network communications may utilize various wired and/or wireless short range or long range carriers and protocols, including radio frequency (RF), satellite, microwave, Institute of Electrical and Electronics Engineers (IEEE) 802.11, 802.15.4, 802.16, 802.20, Bluetooth, optical, infrared, cable, laser, etc. Protocols for 802.11 may also be referred to as wireless fidelity (WiFi) protocols. Protocols for 802.15.4 may also be referred to as wireless personal area network (WPAN) protocols. Protocols for 802.16 may also be referred to as WiMAX or wireless metropolitan area network protocols, and information concerning those protocols is currently available at grouper.ieee.org/groups/802/16/published.html.

The invention may be described herein with reference to data such as instructions, functions, procedures, data structures, application programs, configuration settings, etc. When the data is accessed by a machine, the machine may respond by performing tasks, defining abstract data types, establishing low-level hardware contexts, and/or performing other operations, as described in greater detail below. The data may be stored in volatile and/or non-volatile data storage. For purposes of this disclosure, the term "program" covers a broad range of software components and constructs, including applications, drivers, processes, routines, methods, modules, and subprograms. The term "program" can be used to refer to a complete compilation unit (i.e., a set of instructions that can be compiled independently), a collection of compilation units, or a portion of a compilation unit. The term "program" may also be used to refer to a set of one or more instructions resulting from processes such as translation, interpretation, compilation, linking, etc. Thus, the term "program" may be used to refer to any collection of instructions which, when executed by a processing system, performs a desired operation or operations.

In the embodiment of FIG. 1, processing system 20 also includes various software resources. For instance, ROM 32 includes a basic input/output system (BIOS), and mass storage device 36 contains an OS and at least one program 40. Processing system 20 can use the BIOS to boot, and can copy the OS and program 40 into RAM 26 and then execute the OS and program 40 on processor 22. Processing system 20 may also store other kinds of data in RAM 26 and/or mass storage 36. For instance, as described in greater detail below, processing system 20 may store one or more medication schedules 42 and one or more activity logs 44.

In the embodiment of FIG. 1, processing system 20 is configured to operate as an activity monitoring station 20, and activity monitoring station 20 can send data to and receive data from various external processing systems. For example, as explained in greater detail below, activity monitoring station 20 can receive motion data from motion detecting devices 50, 60, 70, 80, and activity monitoring station 20 can send control data to one or more of those motion detecting devices.

In the embodiment of FIG. 1, activity monitoring station 20 and motion detecting devices 50, 60, 70, 80, are part of a WPAN or LAN 64. For example, activity monitoring station 20 may communicate with motion detecting devices 50, 60, 70, 80 via an I/O port 28 and wireless connections 96. Activity monitoring station 20 may also communicate with a remote data processing system 90 via a WAN, using wired and/or wireless connections. For instance, activity monitoring station 20 may use I/O port 28 or another I.O port (e.g., NIC 30) to communicate with remote processing system 90.

In the embodiment of FIG. 1, monitoring program 40 includes control logic for monitoring and guiding human subjects interacting with objects. Motion detecting device 50 may also include control logic 56 for monitoring and guiding human subjects interacting with objects. Motion detecting devices 60, 70, 80 may also include such control logic. The control logic in the motion detecting devices may cooperate to with monitoring program 40 to implement the operations described herein.

Motion detecting device 50 may also include a motion detector 54, one or more output devices such as a display 52 and a speaker 53. Motion detecting device 50 may also include an I/O port 58 for communicating with activity monitoring station 20. I/O port 58 may include an antenna, a transceiver, and amplifier, and other components to support wireless communication. Motion detecting devices 60, 70, 80 may include the same or similar components.

In the example embodiment, motion detecting device 60 is part of a bracelet 62 to be worn by a human subject, and motion detecting device 50 is part of another bracelet to be born by a different human subject. For example, the human subjects may be an elderly couple, the husband may wear motion detecting device 50, and the wife may wear motion detecting device 60. The other motion detecting devices may be attached to various objects with which the human subjects may interact. For example, motion detecting device 80 may be attached to or reside in a medicine container 82, such as a pill bottle. Motion detecting device 70 may be associated with a different pill bottle, or with a different object, such as a safety device associated with a vehicle.

In one embodiment, low-cost long-term wearable sensing technologies are used to facilitate remote care services. The motion detectors may be implemented as small form factor accelerometers, gyroscope-based sensors, piezoelectric switches, mercury tilt switches, and/or other types of sensors. Such sensors may also be used on objects of interest. As described in greater detail below, activity monitoring station 20 may use motion data from these sensors to determine which person in a multi-person household performed a particular activity, such as taking medication on time, eating a meal, traveling in a vehicle, lifting weights, using other types of exercise equipment, etc. Activity monitoring station 20 may use mathematical correlation techniques to compare the motion of a tagged object with the motion of a person to determine whether the person is using the object. This analysis can take place in real time or after-the-fact.

For example, in the case of pill bottle to person correspondence, motion data representing detected three-dimensional motion of a sensor on the bottle can be compared, in a specific time window, with motion data representing detected three-dimensional motion of a sensor on the hand or wrist of the person to determine with high probability that a specific person has taken a specific pill. Such analysis can be extended to track multiple people choosing from multiple pill bottles.

In the case of a people mover, a similar one-to-one time correspondence with the sensor data on the mover and the person in a given timeslot can be used to determine whether the person is walking. In the case of a vehicle, motion detected from a car mounted sensor can be compared with motion from a sensor on a person to determine if the person was riding in that car.

In addition, motion detecting devices may be used to notify the wearer and/or daycare provider that an attempted interaction with an object is either an approved interaction or a disapproved interaction. For instance, a vehicle may be equipped with a safety device capable of preventing the vehicle from being started. That safety device may be movable, but tethered to the vehicle, like a breathalyzer, for instance. In other words, such a motion detector would not be rigidly attached to the main structure of the car, but would be movable, relative to the rest of the car. The human subject may be instructed to move the safety device before attempting to start the vehicle, and the safety device may prevent the vehicle from being started if the activity schedule indicates that operation of the vehicle by the human subject is not allowed at the present time. Alternatively, motion detectors connected to the driver's side car door or to a key ring may be used to determine that the subject is likely to try starting the car, and the car can be disabled if the schedule disapproves of the subject driving at the present time. Alternatively, the human subject may be allowed to start the vehicle, but activity monitoring station 20 may automatically transmit a message to a caregiver indicating that the human subject has started the vehicle at a disapproved time.

Alternatively, the motion detector associated with the car may be rigidly attached to the main structure of the car, and the activity monitoring station may simply correlate motion of the entire vehicle with motion of the subject. In such an implementation, the monitoring station may send a warning message to a caregiver in response to detecting that the subject is moving/riding in the vehicle at a disallowed time.

Figure 2:
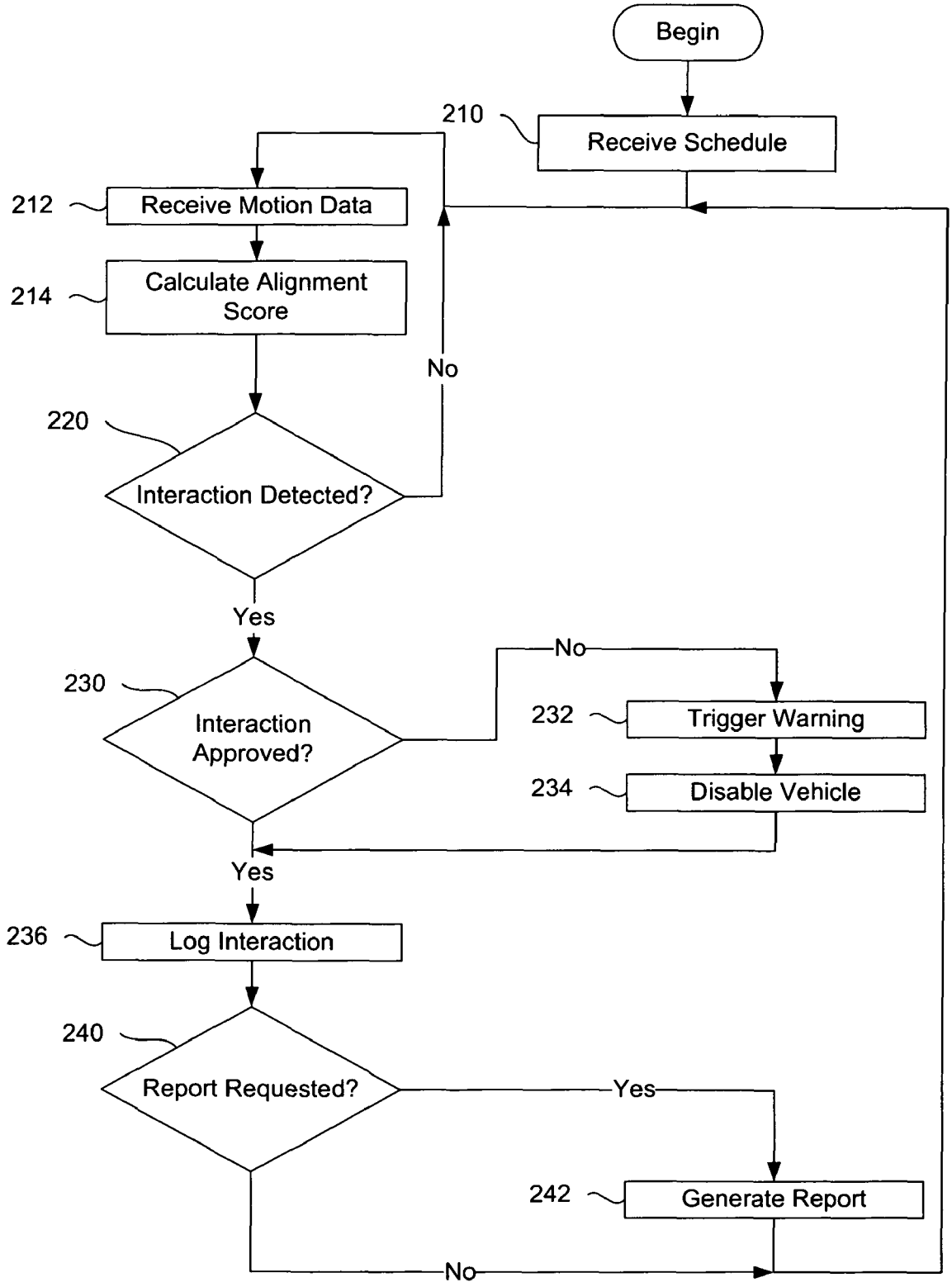
FIG. 2 is a flowchart depicting an example embodiment of a process for monitoring and guiding human subjects interacting with objects, in the context of the data processing environment of FIG. 1.

FIG. 2 is a flowchart depicting an example embodiment of a process for monitoring and guiding human subjects interacting with objects, in the context of the data processing environment of FIG. 1. That process may begin after the necessary hardware components have been deployed in the location of interest. For instance, the process may begin after activity monitoring station 20 has been installed in the residence of the elderly couple, after the husband and wife have put on their respective bracelets, and after the other motion detecting devices have been placed in or attached to the objects to be monitored.

Block 210 depicts activity monitoring station 20 receiving one or more medication schedules pertaining to the elderly couple. For instance, activity monitoring station 20 may receive the schedule from remote processing system 90 or from a removable storage device. In one embodiment, activity monitoring station 20 receives one schedule listing the medications that the husband is scheduled to take and time parameters describing when each medication should be taken, and monitoring station 20 receives another schedule with the same kind of information for the wife.

In alternative embodiments, other types of schedules may be used. These schedules may be referred to as activity schedules or interaction schedules. For instance, activity monitoring station 20 may receive a schedule indicating times during which a particular human subject should be allowed to operate a vehicle, and times during which a subject should not be allowed to operate a vehicle. The schedule may also include similar types of information describing allowed and disallowed interactions with other objects. The schedule may also include recommended actions with recommended times for those actions. For instance, the schedule may describe a recommended diet program and/or a recommended medication schedule. As explained in greater detail below, activity monitoring station 20 may raise alerts and may prompt the subjects to perform scheduled activities, in response to detecting that a scheduled activity has not occurred.

As indicated at block 212, activity monitoring station 20 may then receive motion data from the various motion detecting devices. For instance, when the motion detecting devices are moved, the motion detecting devices may produce motion data for samples of that motion. The motion detecting devices made thus quantitize that motion.

For instance, each motion detecting device may derive and transmit a three-dimensional motion vector every "n" milliseconds. Such a motion vector may be referred to as a motion data item. Each motion data item may describe the direction of the displacement of the motion detecting device between two points during a fixed period of time. Each motion data item may also describe the magnitude of displacement. Motion detecting devices may also generate null vectors to indicate no motion. The motion detecting devices may automatically transmit the motion data to activity monitoring station 20. Activity monitoring station 20 may calibrate the motion data from the motion detecting devices to compensate for differences in sensitivity of different motion detecting devices, for different quantitization formulas used by different motion detecting devices, for different starting orientations of motion detecting devices, for a different magnitude of motion for an object compared to the motion of the person, or etc.

In one embodiment, the motion detecting devices are substantially time synchronized, so that similar motion paths can be compared within the same time window. However, the alignment algorithm may compensate for clock offset between two sensors, as long as the difference in time is substantially smaller than the time window used for comparing the two motion sequences.

As shown at block 214, after receiving motion data from the motion detecting devices, activity monitoring station may calculate alignment scores based on the received motion data. Motion data and alignment scores are described in greater detail below with regard to FIGS. 3-5.

Figure 3:
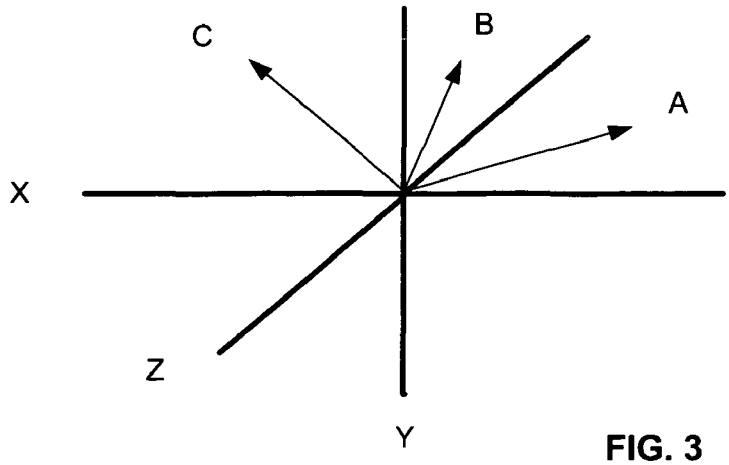
FIG. 3 is a diagram depicting an example set of vectors describing motions of an object.

FIG. 3 is a diagram depicting an example set of vectors describing motions of an object, in three dimensions. Thus, the diagram of FIG. 3 includes X, Y, and Z axes. The arrows A, B, and C extend from the origin with different lengths and orientations to represent motion vectors corresponding to the direction and magnitude of motion of an object, for three different motions.

Figure 4:
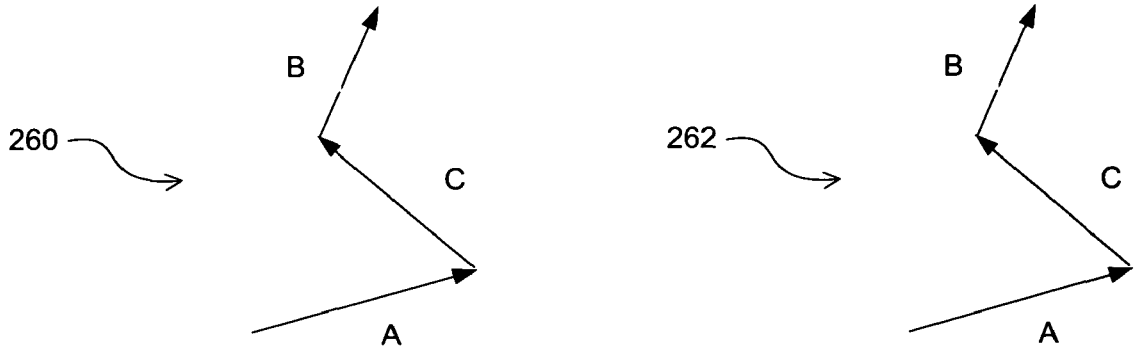
FIG. 4 is a diagram depicting two example sets of vectors received from two motion detecting devices.

FIG. 4 is a diagram depicting two example sets of vectors received from two motion detecting devices. Vector set 260 describes a sequence of motions for a first object. For instance, vector set 260 may represent motion of bracelet 62 along vector A, vector C, and vector B, in that sequence. Vector set 262 may describes a substantially similar sequence of motions for a second object (e.g., medicine container 82). In the embodiment of FIG. 4, the motions of those devices match.

Figure 5:
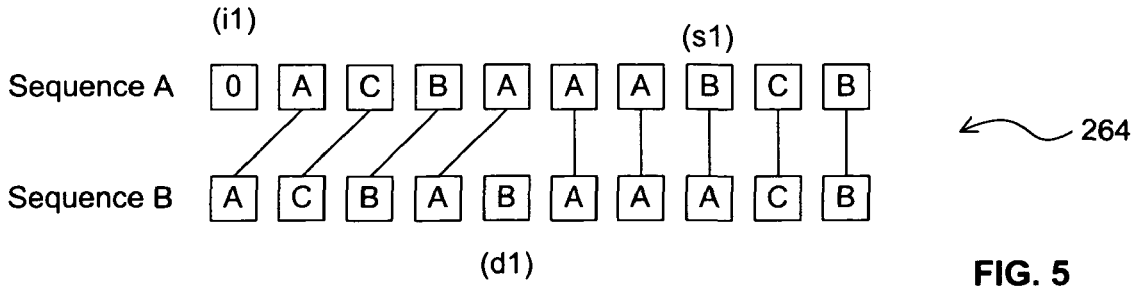
FIG. 5 is a diagram illustrating a comparison of two sets of vectors.

FIG. 5 is a diagram illustrating a comparison of two sets of motion vectors. Monitoring program 40 may use this type of approach to calculate an alignment score, and monitoring program 40 may use alignment scores to determine whether a particular human subject is interacting with a particular object. In alternative embodiments, different approaches may be used to calculate alignment scores.

In the embodiment of FIG. 5, monitoring program 40 finds the best alignment between two sequences of motion vectors based on the number of substitutions (s), deletions d), and insertions (i) necessary to make the sequences equal. For instance, monitoring program 40 may compute alignment scores as follows:

$$1-(\#\text{ of insertions}+\#\text{ of deletions}+\#\text{ of substitutions})/(\#\text{ of symbols in sequence A})$$

Accordingly, monitoring program 40 may compute the alignment score for the two sets of vectors in FIG. 5 as follows:

$$1-(1+1+1)/(10)=1-3/10=0.7$$

Monitoring program 40 may compute the alignment score over a window of time covering the last "m" vectors of each sequence.

Referring again to FIG. 2, as shown at block 220, activity monitoring station 20 may determine whether or not one of the human subjects has interacted with one of the objects, based on the alignment scores. When the alignment score exceeds a given threshold, monitoring program 40 declares the two sequences to be a match, reflecting a determination that the two objects generating the sequences followed the same motion path during that period of time.

Thus, activity monitoring station 20 may determine that two sets of vectors match if the corresponding vectors in both sets point roughly in the same direction. Exact equality is not necessary, since too long sequences of nearly identical vectors are unlikely to be detected unless the two objects in motion are following roughly the same path. In one embodiment, monitoring program 40 compares the relative angles of the motion vectors, rather than the absolute orientation of the motion vectors.

As shown at block 230, after determining that a particular person has interacted with a particular object, monitoring program 40 may determine whether such an interaction is an approved interaction or a disapproved interaction, based on the information in medication schedule 42, the present time, etc. If the interaction is approved, monitoring program 40 may simply record information pertaining to the interaction in the activity log 44, as depicted at block 236. However, if the interaction is disapproved, monitoring program 40 may trigger a warning, as shown at block 232.

Various different types of warnings may be triggered in different circumstances. For example, if monitoring program 40 detects that the husband is moving a pill bottle with medicine for the wife, monitoring program 40 may send a warning signal to the motion detecting device worn by the husband to cause that motion detecting device to generate a warning. For instance, monitoring program 40 may cause the motion detecting device to illuminate a red light. In other embodiments, other types of warning mechanism or techniques may be used, (e.g., audio/sound, vibration of an object, text or graphics displayed on a TV or computer screen, email or text messages sent to a caregiver, logging of data on a backend server for later viewing by a caregiver, etc.).

By contrast, if the interaction is approved, monitoring program 40 may trigger a confirmation message. For instance, monitoring program 40 may cause the motion detecting device worn by the husband to illuminate a green light in response to determining that the husband is moving a pill bottle for a pill the husband is scheduled to take. Alternatively, monitoring program 40 may use the motion detecting device on the object that is being moved to generate the warning message or confirmation message. In other embodiments, other types of confirmation mechanism or techniques may be used, (e.g., audio/sound, vibration of an object, text or graphics displayed on a TV or computer screen, email or text messages sent to a caregiver, logging of data on a backend server for later viewing by a caregiver, etc.).

As shown at block 234, in addition to triggering a warning, monitoring program 40 may take steps to prevent the human subject from performing a disapproved action. For instance, as described above, in response to determining that a person is attempting to use a vehicle a disapproved time, based on motion data from a motion detecting device on the person and a motion detecting safety device in the vehicle, monitoring program 40 may send a signal to the safety device to cause the safety device to prevent the vehicle from being started.

As indicated at block 236, data describing disapproved actions and the corresponding responses generated by monitoring program 40 may also be logged. For each detected interaction, activity log 44 may record the person and the object involved in the interaction, the time of the interaction, whether the interaction was approved or disapproved, and the response taken by monitoring program 40.

In addition, monitoring program 40 may send signals to motion detecting devices to prompt a human subject to conduct a scheduled interaction. For instance, if it is time for the husband to take a particular pill, monitoring program 40 may cause a green light to be displayed on the motion detecting device worn by the husband, while also causing a green light to be displayed on the motion detecting device associated with the appropriate pill bottle. Similarly, to assist in an exercise program in which the wife is scheduled to lift specified weights a specified number of times in a specified sequence, monitoring program 40 may cause a green light to be displayed on a motion detecting device on the first weight to be lifted, until the prescribed lifting regimen for that weight has been completed. At that time, monitoring program 40 may turn off the green light on the first weight, and turn on a green light on the second prescribed weight. Monitoring program 40 may use this kind of approach to guide subjects through complex exercise regimens. In addition, monitoring program 40 may automatically record data that accurately describes the exercises performed by multiple individuals. For instance, this data may list the different weights lifted by the wife, the number of lift repetitions in each set, the number of sets, the sequence of exercises, the time spent exercising, etc.

As indicated at block 242, monitoring program 40 may then determine whether a report has been requested. For instance, monitoring program 40 may receive a request for a report from a remote caregiver at remote processing system 90, or monitoring program 40 may automatically generate reports according to a predetermined schedule requesting reports. If the report has been requested, monitoring program 40 may generate that report, as shown at block 242. In one embodiment, a report is produced for each human subject wearing a motion detecting device. Such a report may indicate whether that subject has properly interacted with objects associated with motion detecting devices, according to the activity schedule or medication schedule 42. For example, the reports may indicate that the husband has taken all medication according to schedule, but the wife did not take a particular medication according to schedule. Thus, the reports may specify which medications were missed, when they were missed, which medications were taken improperly, etc. Monitoring program 40 may save and/or print the reports locally. Alternatively or in addition, monitoring program 40 transmit such reports to a caregiver at remote processing system 90.

Reports may also describe the exercise programs completed by the human subjects, including the information described above. Furthermore, a facility such as a health club may use techniques such as those described herein to track and report on exercise activities of multiple individuals interacting with multiple different objects. For example, dozens of people may be sharing the equipment in a health club at any one time, and the techniques described herein may be used to provide each person with a report describing the particular exercise regimen completed by that person.

As has been described, motion detecting devices may be used to monitor and guide human subjects interacting with objects. In light of the principles and example embodiments described and illustrated herein, it will be recognized that the illustrated embodiments can be modified in arrangement and detail without departing from such principles.

Also, the foregoing discussion has focused on particular embodiments, but other configurations are contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments.

Similarly, although example processes have been described with regard to particular operations performed in a particular sequence, numerous modifications could be applied to those processes to derive numerous alternative embodiments of the present invention. For example, alternative embodiments may include processes that use fewer than all of the disclosed operations, processes that use additional operations, processes that use the same operations in a different sequence, and processes in which the individual operations disclosed herein are combined, subdivided, or otherwise altered.

Alternative embodiments of the invention also include machine accessible media encoding instructions for performing the operations of the invention. Such embodiments may also be referred to as program products. Such machine accessible media may include, for example, storage media such as floppy disks, hard disks, CD-ROMs, ROM, and RAM; and other detectable arrangements of particles manufactured or formed by a machine or device. Instructions may also be used in a distributed environment, and may be stored locally and/or remotely for access by single or multi-processor machines.

It should also be understood that the hardware and software components depicted herein represent functional elements that are reasonably self-contained so that each can be designed, constructed, or updated substantially independently of the others. The control logic for providing the functionality described and illustrated herein may be implemented as hardware, software, or combinations of hardware and software in different embodiments. For instance, one or more modules, subsystems, etc., in one or more devices may be implemented as embedded controllers, using components such as programmable or non-programmable logic devices or arrays, application-specific integrated circuits (ASICs), embedded processors, smart cards, and the like.

As used herein, the terms "processing system" and "data processing system" are intended to broadly encompass a single machine, or a system of communicatively coupled machines or devices operating together. Example processing systems include, without limitation, distributed computing systems, supercomputers, high-performance computing systems, computing clusters, mainframe computers, mini-computers, client-server systems, personal computers, workstations, servers, portable computers, laptop computers, tablets, telephones, personal digital assistants (PDAs), handheld devices, entertainment devices such as audio and/or video devices, and other platforms or devices for processing or transmitting information.

In view of the wide variety of useful permutations that may be readily derived from the example embodiments described herein, this detailed description is intended to be illustrative only, and should not be taken as limiting the scope of the invention. What is claimed as the invention, therefore, is each implementation that comes within the scope and spirit of the following claims, and all equivalents to such implementations.

What is claimed is:

1. A method for monitoring and guiding two or more human subjects, each scheduled to take medication, the method comprising:

receiving, at the activity monitoring station, an interaction schedule for a first human subject, wherein the interaction schedule lists objects with which the first human subject is scheduled to interact and time parameters for interactions;

receiving, at the activity monitoring station, motion data from a first motion detecting device worn by the first human subject;

receiving, at the activity monitoring station, motion data from a second motion detecting device worn by the second human subject;

receiving, at the activity monitoring station, motion data from a third motion sensing device situated on or in a first medicine container;

generating a first motion alignment score based on a mathematical correlation of one or more vectors of the motion data from the first motion detecting device with one or more vectors of the motion data from the third motion detecting device;

generating a second motion alignment score based on a mathematical correlation of one or more vectors of the motion data from the second motion detecting device with the one or more vectors of the motion data from the third motion detecting device;

determining whether the first human subject moved the first medicine container or, if the first human subject did not move the first medicine container, whether the second human subject moved the first medicine container, wherein the determination is based on the first motion alignment score and based on the second motion alignment score outputting a prompt to the first human subject to take medication if it is determined that the first human subject did not move the first medicine container and if it is determined from the interaction schedule that the first human is scheduled to take medication.

2. The method according to claim 1, further comprising illuminating a light on the third motion detecting device.

3. The method of claim 1, wherein the motion alignment score is based on a number of vectors needed to be deleted from and a number of vectors needed to be substituted into the motion data from the first motion detecting device to make the motion data from the first motion detection device equal to the motion data from the third motion detecting device.

4. The method of claim 1, wherein the motion alignment score is based on a number of vectors needed to be deleted from and a number of vectors needed to be substituted into the motion data from the third motion detecting device to make the motion data from the second motion detection device equal to the motion data from the third motion detecting device.

5. An article of manufacture, comprising:

a tangible, non-transitory machine-accessible medium; and instructions in the machine-accessible medium for monitoring two or more human subjects, each scheduled to take medication, wherein the instructions, when executed by a processing system, cause the processing system to perform operations comprising:

receiving, at the activity monitoring station, an interaction schedule for a first human subject, wherein the interaction schedule lists objects with which the first human subject is scheduled to interact and time parameters for interactions;

receiving, at the activity monitoring station, motion data from a first motion detecting device worn by the first human subject;

receiving, at the activity monitoring station, motion data from a second motion detecting device worn by the second human subject;

receiving, at the activity monitoring station, motion data from a third motion sensing device situated on or in a first medicine container;

generating a first motion alignment score based on a mathematical correlation of one or more vectors of the motion data from the first motion detecting device with one or more vectors of the motion data from the third motion detecting device;

generating a second motion alignment score based on a mathematical correlation of one or more vectors of the motion data from the second motion detecting device with the one or more vectors of the motion data from the third motion detecting device;

determining whether the first human subject moved the first medicine container based on whether the first motion alignment score is greater than the second motion alignment score;

outputting a prompt to the first human subject to take medication if it is determined that the first human subject did not move the first medicine container and if it is determined from the interaction schedule that the first human is scheduled to take medication.

6. A processing system to help monitor and guide two or more human subjects, each scheduled to take medication, the processing system comprising:

a processor; and control logic which, when used by the processor, results in the processing system performing operations comprising:

receiving, at the activity monitoring station, an interaction schedule for a first human subject, wherein the interaction schedule lists objects with which the first human subject is scheduled to interact and time parameters for interactions;

receiving, at the activity monitoring station, motion data from a first motion detecting device worn by the first human subject;

receiving, at the activity monitoring station, motion data from a second motion detecting device worn by the second human subject;

receiving, at the activity monitoring station, motion data from a third motion sensing device situated on or in a first medicine container;

generating a first motion alignment score based on a mathematical correlation of one or more vectors of the motion data from the first motion detecting device with one or more vectors of the motion data from the third motion detecting device;

generating a second motion alignment score based on a mathematical correlation of one or more vectors of the motion data from the second motion detecting device with the one or more vectors of the motion data from the third motion detecting device;

determining whether the first human subject moved the first medicine container based on whether the first motion alignment score is greater than the second motion alignment score;

outputting a prompt to the first human subject to take medication if it is determined that the first human subject did not move the first medicine container and if it is determined from the interaction schedule that the first human is scheduled to take medication.

* * * * *